US007523602B2

(12) United States Patent
Patel et al.

(10) Patent No.: US 7,523,602 B2
(45) Date of Patent: Apr. 28, 2009

(54) TURBINE EXHAUST CATALYST

(75) Inventors: Anant Rambhai Patel, Rocky Hill, CT (US); Bernard G. Staib, Farmington, CT (US)

(73) Assignee: United Technologies Corporation, Hartford, CT (US)

( * ) Notice: Subject to any disclaimer, the term of this patent is extended or adjusted under 35 U.S.C. 154(b) by 627 days.

(21) Appl. No.: 11/235,766

(22) Filed: Sep. 27, 2005

(65) Prior Publication Data

US 2007/0068167 A1 Mar. 29, 2007

(51) Int. Cl.
*F02C 7/08* (2006.01)
*F02C 7/22* (2006.01)

(52) U.S. Cl. ..... 60/39.5; 60/777

(58) Field of Classification Search ..... 60/39.5, 60/777, 723, 39.181, 39.182; 431/7, 170, 431/328

See application file for complete search history.

(56) References Cited

U.S. PATENT DOCUMENTS 4,118,171 A * 10/1978 Flanagan et al. ..... 431/10
4,280,329 A * 7/1981 Rackley et al. ..... 60/754
5,461,864 A * 10/1995 Betta et al. ..... 60/723
5,826,422 A * 10/1998 Koyama et al. ..... 60/39.12
6,269,628 B1 8/2001 Gates
6,532,743 B1 3/2003 Fischer
6,629,414 B2 10/2003 Fischer
2004/0011056 A1* 1/2004 Yee et al. ..... 60/777
2006/0225402 A1* 10/2006 Kierspe et al. ..... 60/39.5

FOREIGN PATENT DOCUMENTS

CH 679236 1/1992

* cited by examiner

*Primary Examiner*—Michael Cuff
*Assistant Examiner*—Gerald L Sung
(74) *Attorney, Agent, or Firm*—Marjama Muldoon Blasiak & Sullivan LLP

(57) ABSTRACT

In a gas turbine installation having an enclosure for passing cooling air therethrough and around the gas turbine, provision is made for a mixing of the cooling air with the exhaust gases being emitted from the gas turbine to thereby reduce the temperature thereof prior to its passing into the exhaust stack, but only after the primary air has passed through a catalyst bed which is disposed in a position over the gas turbine exhaust opening. The shape of the catalyst bed is preferably A-shaped in cross-section to thereby increase the surface area thereof. In this way, the temperature at the catalyst bed is maintained at an elevated level to obtain superior performance while a subsequent mixing of the primary air with the cooling air results in lower temperatures of the gases passing through the exhaust stack.

7 Claims, 1 Drawing Sheet

TURBINE EXHAUST CATALYST

BACKGROUND OF THE INVENTION

This invention relates generally to gas turbines and, more particularly, to a catalyst bed which is placed in the exhaust stream of a gas turbine.

In an effort to reduce undesirable emissions such as carbon monoxide, it has become common to provide a catalyst bed at the exhaust to reduce the harmful emissions prior to the exhaust gases being passed through the exhaust stack and into the atmosphere.

It has also become customary to provide a flow of cooling air within the enclosure around a gas turbine and to mix the cooling air with the gas turbine exhaust gases so that the temperatures are reduced when passing through the exhaust silencers and the exhaust stack. It has been recognized that if a catalyst bed is introduced in such an arrangement, that both the turbine exhaust gases and the cooling air pass through the catalyst bed, then the pressure drop through the catalyst would cause excessive pressure rise in the enclosure and reduce the temperature at the catalyst, thereby rendering it less effective.

One conventional approach for solving this problem is to allow the cooling air to flow over the turbine only and not to mix the cooling air with the gas turbine primary air. While this approach reduces the pressure drop across the catalyst and makes it more effective, the benefits of reduced exhaust temperature which would otherwise occur from the mixing of the gases are lost.

SUMMARY OF THE INVENTION

Briefly, in accordance with one aspect of the invention, instead of the catalyst bed being placed across the enclosure, the catalyst bed is placed immediately downstream of the gas turbine exhaust such that the primary exhaust air passes through the catalyst prior to being mixed with the cooling air. In this way, the enclosure pressure remains low while the catalyst effectiveness is optimized. Further, the temperature of the exhaust gases are reduced by the mixing with the cooling air prior to the mixture being passed through the exhaust stack.

By another aspect of the invention, the catalyst bed is formed in an A-shaped structure so as to thereby increase the surface area of the catalyst bed and reduce the velocity of the exhaust gases therethrough so that the silencer and stack retain the acoustic, structural and other benefits associated with the reduced temperatures.

In the drawings as hereinafter described, a preferred embodiment is depicted; however, various other modifications and alternate constructions can be made thereto without departing from the spirit and scope of the invention.

DESCRIPTION OF THE PREFERRED EMBODIMENT

Figure 1:
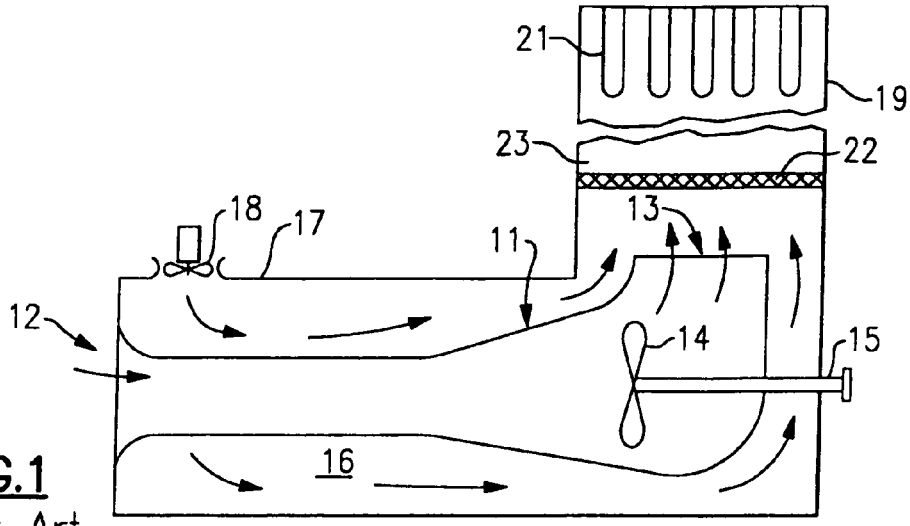
FIG.1 Prior Art
FIG. 1 is a schematic illustration of a gas turbine installation with an associated catalyst in accordance with the prior art.

Referring now to FIG. 1, a gas turbine is shown at 11 having an inlet opening 12 connected to inlet plenum and an exhaust opening 13. In operation, ambient air is admitted to the inlet opening 12 and passes through the turbine 14 to provide motive power thereto, thereby causing rotary motion to the shaft 15. The cooler, lower pressure gases then pass out through the exhaust opening 13.

Because of the high temperatures within the gas turbine 11, it is desirable to provide a cooling function thereto by way of cooling air which is circulated within an envelope or enclosed space 16 defined by an enclosure 17 surrounding the gas turbine 11. The cooling air is caused to pass through envelope 16 by way of one or more fans 18, with the cooling air then flowing in the direction indicated by the arrows and towards the exhaust opening 13.

In addition to the function of cooling the gas turbine 11 itself, the cooling air has also been used to cool the exhaust gases, that are emitted from the exhaust opening 13. That is, at the downstream end of the exhaust opening 13 the exhaust gases are mixed with the cooling air so as to reduce the temperature of the exhaust gases prior to their entering the exhaust stack 19. This temperature difference is important when considering the detrimental effect of high temperature gases to the exhaust stack 19 and/or to the silencers 21 therein.

Because of environmental concerns, a catalyst bed 22 is placed across the downstream end of the turbine enclosure as shown so as to reduce the content of undesirable gases such as carbon monoxide from the mixture being passed to the environment by way of the exhaust stack 19. The catalyst bed 22 typically comprises a catalyst material capable of converting CO to $CO_2$. Such catalyst materials are known in the art and generally comprise a noble metal (for example, gold, silver, platinum, palladium) or other material known to catalyze the chemical conversion of CO to $CO_2$. As one skilled in the art would appreciate, the particular catalyst material selected for use in the catalyst bed of the present invention is not important as long as the catalyst material is capable of performing the desired conversion of CO to $CO_2$.

It has been recognized by the inventors that, if the catalyst were to be placed as shown (i.e. after the exhaust gases and the cooling air have been mixed), then the extra cooling air passing through the catalyst bed 22 would reduce the temperature at the catalyst, making the catalyst less effective. In addition there would be a substantially greater pressure drop across the catalyst bed, which would cause an excessive pressure rise in the enclosure 17. This higher pressure would make design of the enclosure very difficult.

Figure 2:
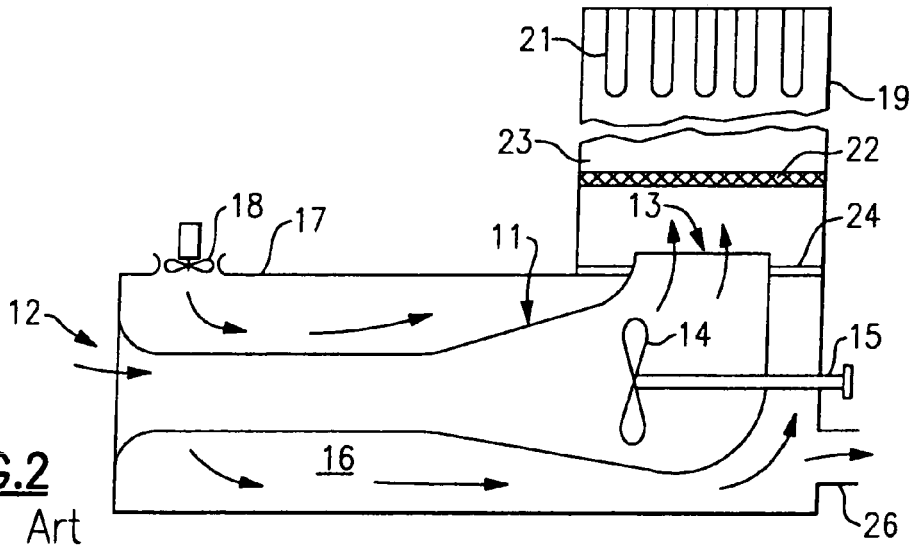
FIG.2 Prior Art
FIG. 2 is a schematic illustration of an alternate embodiment of a gas turbine installation with an associated catalyst bed in accordance with the prior art.

An alternative approach to overcome the above described problem is shown in FIG. 2. Here, the area between the enclosure 17 and the exhaust opening 13 is closed off by a wall 24 so that a mixture of the cooling air with the primary air does not occur. The cooling air is made to circulate around the gas turbine 11 to cool it as before, and an alternative opening 26 is provided for the flow of the cooling air outwardly from the enclosure 17. Because the mixture of cooling air and primary air does not occur, there is no excessive pressure rise upstream of the catalyst bed, and it therefore performs in a satisfactory manner. The disadvantage, however, is that the temperature of the exhaust gases is not reduced prior to its entry into the exhaust stack 19, and therefore the exhaust stack 19 and the silencer structure 21 are exposed to the higher temperatures and therefore could exhibit a shorter life.

Figure 3:
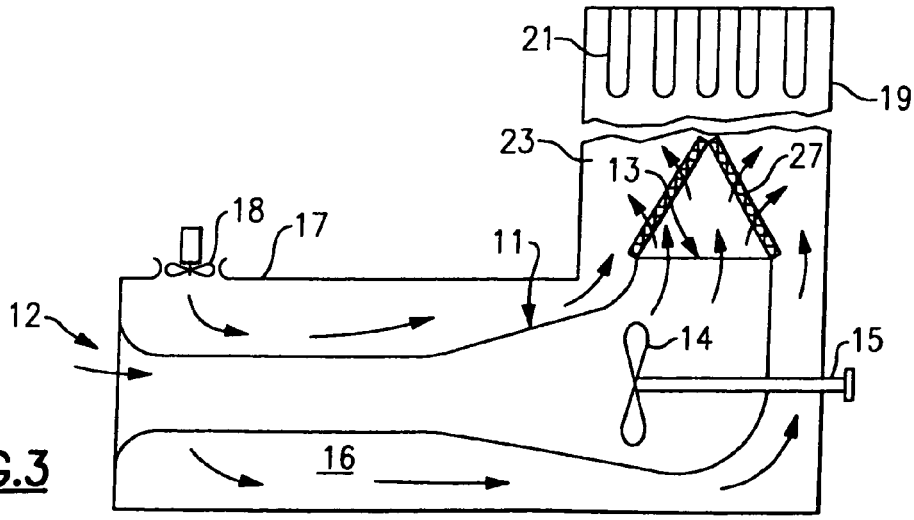
FIG. 3 is a schematic illustration of a gas turbine installation with an associated catalyst bed in accordance with one aspect of the present invention.

Referring now to FIG. 3, there is shown an installation of a catalyst bed 27 that seeks to overcome the problems discussed above. Rather than the catalyst bed 27 being placed across the downstream end of the envelope 23, it is placed only over the exhaust opening 13 as shown such that the primary air passes first through the catalyst bed 27 and is only then mixed with the cooling air prior to passing into the exhaust stack 19. In this way, the high pressure condition upstream of the catalyst bed 27 is avoided to allow optimum performance of the catalyst bed 27 while, at the same time, a mixing of the exhaust gases with the cooling air is encouraged so as to reduce the temperatures to a preferred level as they flow into the exhaust stack 19.

It should be recognized that the shape of the catalyst bed 27 can be varied substantially. However, it is desirable to increase the surface area as much as possible, which in turn, will reduce the velocity of the exhaust gases passing therethrough, and will therefore add to the effectiveness of the catalyst bed 27. For this reason, a tent-shaped or A-shaped catalyst bed 27 as shown is a preferred shape for the catalyst bed 27.

While the present invention has been particularly shown and described with reference to a preferred embodiment as illustrated in the drawings, it will be understood by one skilled in the art that various changes in detail may be effected therein without departing from the scope of the invention as defined by the claims.

We claim:

1. A gas turbine assembly, comprising:

a gas turbine having an inlet for primary air and an exhaust outlet;

a catalyst bed disposed at said outlet for receiving said exhaust gases;

an enclosure disposed around the gas turbine and defining an enclosed space between the gas turbine and said enclosure;

a source of cooling air for passing through said enclosed space and for mixing with exhaust gases after it passes through said catalyst bed; and an exhaust stack connected to said enclosed space for conducting the flow of the cooling air/exhaust gases mixture to the atmosphere.

2. A gas turbine as set forth in claim 1 wherein said catalyst bed is A-shaped in cross-sectional form, with the apex being orientated downstream.

3. A method of reducing emissions from the exhaust outlet of a gas turbine comprising the steps of:

providing a catalyst bed at the gas turbine exhaust outlet for the passing of gas turbine exhaust gases therethrough;

providing a flow of cooling air to be mixed with said exhaust gases only after it passes through said catalyst bed; and causing a mixture of cooling air and exhaust gases to flow to an exhaust stack and to be discharged to atmosphere.

4. A method as set forth in claim 3 wherein said catalyst bed is A-shaped in form with its apex orientated in the downstream direction.

5. A gas turbine of the type having an inlet and an outlet, an enclosure for defining an enclosed space between the gas turbine and the enclosure, and a source of cooling air to be circulated through the enclosed space and then mixed with exhaust gases being emitted from the gas turbine outlet and including:

a catalyst disposed at said gas turbine outlet such that said exhaust gases pass first through said catalyst bed and are subsequently mixed with the cooling air and including an exhaust stack for conducting the flow of the cooling air/exhaust gases mixture from the space to the atmosphere.

6. A gas turbine as set forth in claim 5 wherein said exhaust stack includes one or more silencer elements therein.

7. A gas turbine as set forth in claim 5 wherein sad catalyst bed is A-shaped in cross-sectional form, with its apex being orientated downstream.

* * * * *